US006102694A

United States Patent [19]

Lenz

[11] Patent Number: 6,102,694

[45] Date of Patent: Aug. 15, 2000

[54] PIPE REFRACTORY INSULATION FOR FURNACES

[75] Inventor: Kevin Lenz, Mokena, Ill.

[73] Assignee: M. H. Detrick Co., Mokena, Ill.

[21] Appl. No.: 09/164,982

[22] Filed: Oct. 1, 1998

[51] Int. Cl.[7] ..... F27D 3/02

[52] U.S. Cl. ..... 432/234; 138/155; 403/179; 403/388; 122/DIG. 13

[58] Field of Search ..... 432/236, 246, 432/247, 248, 234; 110/336; 138/155, 120, 178, 38; 165/134.1; 403/179, 388, 404, 384; 122/6 A, 511, 510, DIG. 13

[56] References Cited

U.S. PATENT DOCUMENTS

| | | | |
|---|---|---|---|
| 3,486,533 | 12/1969 | Doherty et al. | 432/234 |
| 3,572,662 | 3/1971 | Weaver et al. . | |
| 3,647,194 | 3/1972 | Brungraber et al. . | |
| 3,781,167 | 12/1973 | Ahonen . | |
| 3,804,585 | 4/1974 | Twort . | |
| 3,820,947 | 6/1974 | Boto et al. . | |
| 3,838,665 | 10/1974 | Astrom | 122/6 A |
| 3,848,034 | 11/1974 | Schaefer | 432/234 |
| 3,881,864 | 5/1975 | Nicol | 432/234 |
| 3,914,100 | 10/1975 | Guskea | 432/234 |
| 3,941,160 | 3/1976 | Campbell, Jr. | 138/155 |
| 4,015,636 | 4/1977 | Van Fossen | 432/234 |
| 4,070,151 | 1/1978 | Suey . | |
| 4,071,311 | 1/1978 | Errington | 432/234 |
| 4,134,721 | 1/1979 | Davis et al. . | |
| 4,149,846 | 4/1979 | Drew, Jr. . | |
| 4,170,451 | 10/1979 | Luff | 432/234 |
| 4,182,609 | 1/1980 | Hovis et al. . | |
| 4,189,301 | 2/1980 | Twoart . | |
| 4,225,307 | 9/1980 | Magera . | |
| 4,228,826 | 10/1980 | Campbell, Jr. . | |
| 4,312,385 | 1/1982 | Magera . | |
| 4,424,028 | 1/1984 | Magera . | |
| 4,505,303 | 3/1985 | Revere et al. . | |
| 4,528,672 | 7/1985 | Morgan, II et al. . | |
| 4,966,100 | 10/1990 | Fournier et al. | 122/6 A |
| 5,154,139 | 10/1992 | Johnson | 122/510 |
| 5,284,440 | 2/1994 | Campbel, Jr. et al. . | |
| 5,423,294 | 6/1995 | Cole et al. | 122/DIG. 13 |
| 5,542,378 | 8/1996 | Kubiak et al. | 122/511 |
| 5,558,045 | 9/1996 | Cole et al. | 122/6 A |

*Primary Examiner*—Denise L. Ferensic
*Assistant Examiner*—Jiping Lu
*Attorney, Agent, or Firm*—Piper Marbury Rudnick & Wolfe

[57] ABSTRACT

Water-cooled pipes of the type utilized to support steel workpieces in reheat furnaces and the like are insulated by preformed, rigid refractory members. Threaded studs are welded to opposing surfaces of the pipe or the web between a pair of pipes. The pipe(s) are then covered by a ceramic fiber blanket. A pair of the refractory members, each of which contains an aperture through which one of the studs is received, is positioned so as cover the pipe(s) and blanket. Nuts are fastened to the studs to hold the refractory members in place. The refractory members are sized and positioned so that gaps exist between them so as to allow for thermal expansion. These gaps may be filled with blanket insulation or heat-resistant plastic. The remaining portions of the apertures are also filled with heat-resistant plastic.

8 Claims, 7 Drawing Sheets

PIPE REFRACTORY INSULATION FOR FURNACES

BACKGROUND OF THE INVENTION

The invention relates generally to water-cooled members for supporting steel slabs and the like in reheating furnaces, and, more particularly, to refractory insulation for such members.

In the processing of steel, ingots are rolled into shapes such as slabs and subsequently reheated in furnaces for further rolling or other processing. Reheat furnaces are typically pusher furnaces, walking beam furnaces or a combination of the two. Each features a series of lengthwise supports, frequently called skid pipes or skids. These skids are supported in an elevated state by vertical supports so that both sides of the steel slabs may be heated as they travel through the furnace. The steel slabs are typically 9 to 10 inches thick, 30 to 82 inches wide and 30 to 40 feet long and are heated to final temperatures of 2100° F. to 2500° F., depending upon the type of steel and its intended use.

In pusher furnaces, the steel slabs are abutted front-to-back and slide along The skids as they are pushed through the furnace. As a fresh steel slab is introduced into the input end of the pusher furnace, a corresponding heated steel slab is extracted from the discharge end for rolling mill treatments or other processing. In contrast, a typical walking beam furnace has a number of fixed skids with "walking skids" positioned between them. The walking skids are equipped to rise upward, advance forward, withdraw downward and return to their original positions so that the steel slabs within the furnace are incrementally moved forward. In both pusher and walking beam furnaces, the top surfaces of the skids are equipped with wear castings, also known as "riders", that support the steel slabs.

The skids and vertical supports in reheat furnaces must be compact in order to leave sufficient combustion space in the furnace chamber, must be strong enough to support the heavy steel slabs being treated and must be protected against injury by the high temperatures. As a result, hollow metal pipes through which cooling water is circulated are typically used in the construction of these components. If water-cooled pipes with bare outer surfaces are used for the skids and vertical supports, however, the absorption of heat through the pipe metal to the cooling water results in tremendous heat loss from the furnace. It is therefore necessary to insulate the pipes to minimize the heat loss.

Covering the pipes with insulation also protects them from damage due to the high temperature of the furnace.

Previous insulation systems have utilized preformed refractory members that are welded directly to the pipe. Examples of this type of insulation system may be found in U.S. Pat. Nos. 3,647,194; 3,804,585; 4,070,151; 4,134,721 and 4,528,672. These insulation systems utilize members constructed of refractory material within which metal links, coils or fasteners are embedded. A portion of the metal link, coil or fastener is left exposed through a hole in the refractory material. Alternatively, the metal link, coil or fastener may extend out of an end of the member. The refractory members are sized so that they fit upon the pipe being protected. Once positioned on the pipe, the exposed portion of the metal link, coil or fastener may be welded directly to the surface of the pipe.

While these insulation systems have proven effective, the movement of the heavy steel slabs during the heating process causes the skids to flex and vibrate. The impacts of the slabs also subject the skids to shocks. The flexing, vibration and shocks, along with the cyclical heating of the furnace to extremely high temperatures, results in occasional damage to the refractory members necessitating their replacement. Replacement of the refractory members requires that the welds be broken and the remaining weld material ground off the pipe surface. This is a time consuming and labor intensive process during which the furnace may not be operated. Furnace downtime adversely affects the profitability of the operation and must be minimized.

An alternative type of insulation system utilizes preformed refractory members that fasten together to cover pipes. Examples of these types of systems may be found in U.S. Pat. Nos. 3,781,167; 4,182,609; 4,225,307; 4,312,385; 4,424,028 and 4,505,303. In each of these systems, the refractory members are cast so as to include fastening devices such as tabs, clips or hooks. The fastening devices join neighboring, refractory members together after they are positioned upon the pipe. While these systems have also proven to be effective, the replacement of a single refractory member requires that neighboring members also be removed, or at least shifted. This is because each refractory member depends upon neighboring refractory members for support. This complicates the replacement process so that the furnace downtime increases. In addition, there is a greater chance of damage to neighboring refractory members.

U.S. Pat. Nos. 3,941,160 and 4,228,826 disclose interlocking, refractory members for covering and insulating pipes. More specifically, the refractory members are shaped so that they slide into engagement with one another as they are positioned on a pipe. A disadvantage of this arrangement is that, due to abutting neighbor members, a damaged member must be cut in order to be removed. This increases the complexity and time of the replacement process.

A further disadvantage of many of the above insulation systems is that, by utilizing refractory members that are abutting or that are attached by their ends to the pipe, they do not allow for thermal expansion of the refractory members. More specifically, when heated to the extreme temperatures of a reheat furnace, the refractory members may expand against each other or the weld so that they crack.

Finally, U.S. Pat. No. 3,820,947 discloses a fibrous ceramic insulating blanket that is wrapped about a pipe and pressed over anchor studs that project from the pipe. A ceramic anchor is placed over each stud and secured by a nut so that the blanket is held in position against the pipe. The assembly is sprayed with a liquid which hardens to provide a relatively hard and erosion-resistant outer-layer over a resilient inner-layer. A disadvantage of this construction is that it is difficult to replace a single section of the insulation even though only a small portion may be damaged.

Accordingly, it is an object of the present invention to provide a pipe refractory insulation system wherein the refractory members may be quickly replaced.

It is another object of the present invention to provide a pipe refractory insulation system wherein the refractory members may be replaced without removing welds from the pipe.

It is another object of the present invention to provide a pipe refractory insulation system wherein a refractory member may be replaced without disturbing additional refractory members.

It is another object of the present invention to provide a pipe refractory insulation system wherein a refractory member may be replaced without being cut for removal.

It is still another object of the present invention to provide a pipe refractory insulation system that accounts for thermal expansion of the refractory material.

It is still another object of the present invention to provide a pipe refractory insulation system wherein a single section of the refractory material may be replaced.

SUMMARY OF THE INVENTION

The present invention is directed to insulation, and a method of installing same, for fluid-cooled pipes that support workpieces in a furnace such as the type used for reheating steel. A number of threaded studs are welded to opposing surfaces of a pipe or a web between a pair of pipes. A ceramic fiber blanket is then placed around the pipes. A pair of refractory members each of which features an aperture sized to receive a stud, are placed over the pipe(s) and secured in place by nuts fastened to the studs.

While sized to cover a majority of the pipe surface(s), the refractory members are mounted so that gaps exist between them. This allows room for the refractory members to thermally expand without breaking. In the situation where a skid pipe is being insulated, the gaps between the bottom edges of the refractory members are filled with blanket insulation. In contrast. the gaps between the top edges of the refractory members, which contain the wear castings, are filled with heat-resistant plastic. The remaining portions of the apertures are also filled with heat-resistant plastic.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
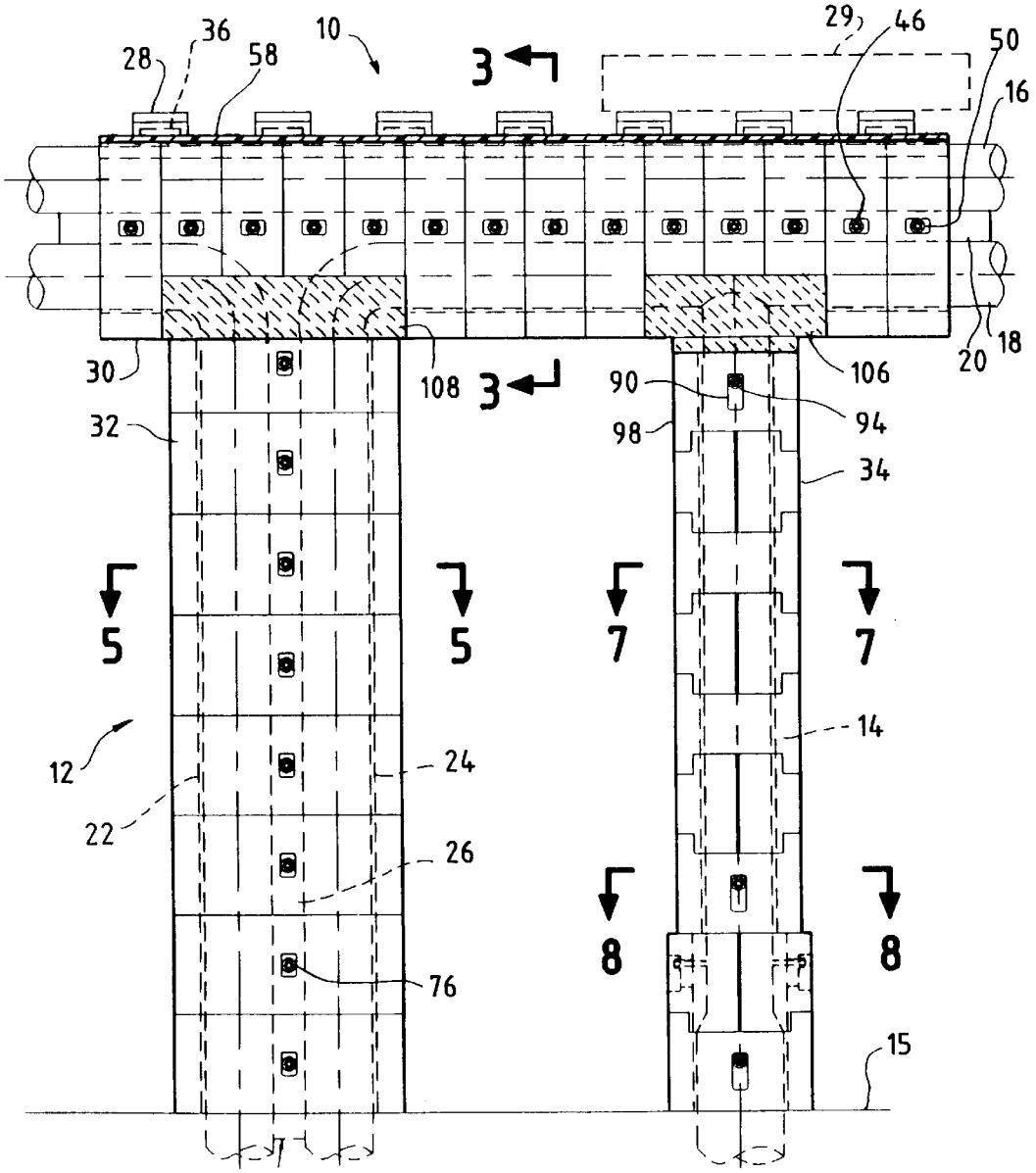
FIG. 1 is a side elevational view showing a portion of a skid pipe and vertical supports therefor in a reheat furnace upon which an embodiment of the pipe refractory insulation of the invention has been installed.

With reference to FIG. 1, a skid pipe indicated generally at 10, is shown positioned upon a dual-pipe vertical support, indicated generally at 12, and a single-pipe vertical support 14. The structure is positioned within a pusher or walking beam reheat furnace, the floor of which is indicated at 15. The skid pipe is actually constructed of steel top and bottom pipes 16 and 18 joined by a steel web 20. Similarly, the steel pipes 22 and 24 of vertical support 12 are joined by steel web 26. The pipe of vertical support 14 is also constructed of steel. While the pipe refractory insulation of the present invention will be discussed herein in terms of a reheat furnace, it will be appreciated that many other similar environments, such as an open hearth furnace, require such insulation systems. Furthermore, while the embodiments shown herein disclose the insulation applied to pipes having a round cross section, it is to be understood that the invention may be applied to pipes having cross sections of other shapes (such as elliptical).

As may be seen from FIG. 1, the bottom pipe 18 of the skid pipe is connected to the pipes of vertical supports 12 and 14. The pipes of the vertical supports pass into the floor 15 and are connected to a water source (not shown). As a result, water flows through the pipes of the vertical supports as well as bottom pipe 18 of the skid pipe. The top pipe 16 of the skid pipe is also connected to a water source so that water flows therethrough. As a result, the skid pipe 10 and the vertical supports 12 and 14 are cooled so that they retain their strength under the extremely high temperatures of the reheat furnace (over 2400° F. in some instances). It should be noted that the insulation of the invention could also be used to cover pipes cooled with an alternative fluid such as air.

Figure 2:
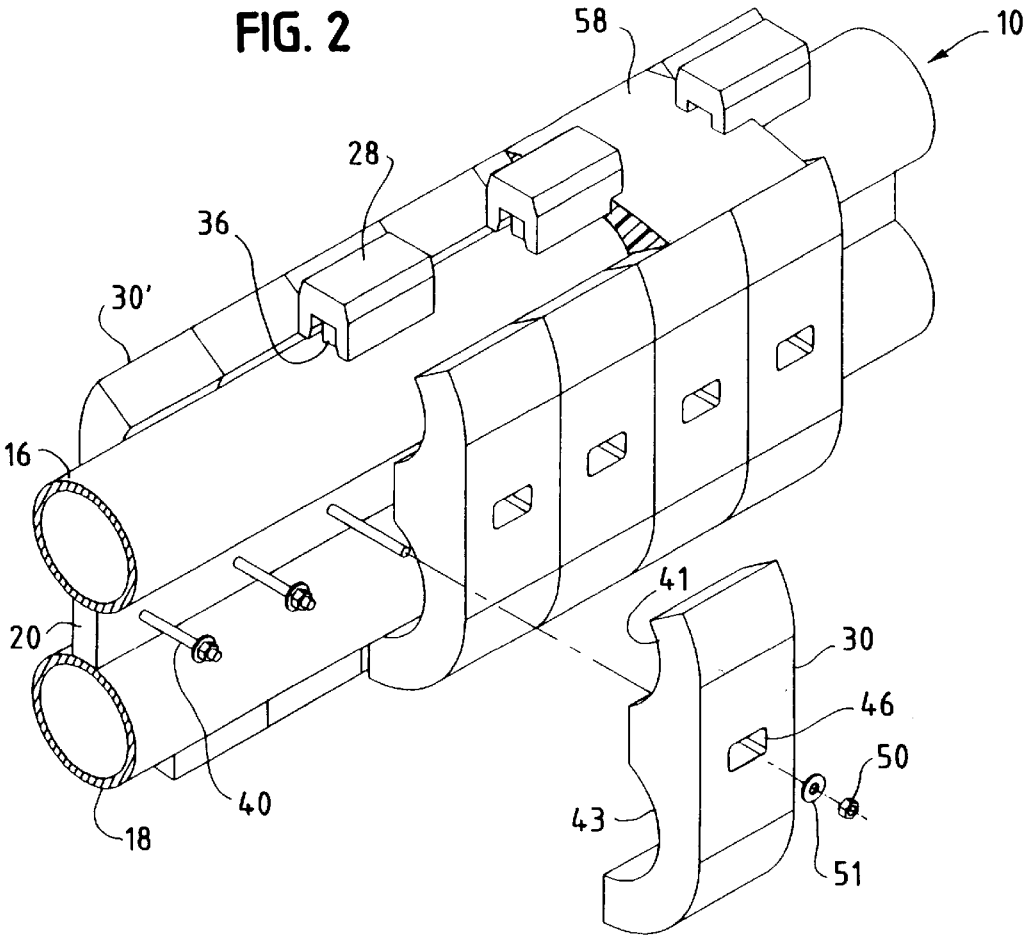
FIG. 2 is a perspective view of the skid pipes of FIG. 1 illustrating the installation of the pipe refractory insulation.
Figure 3:
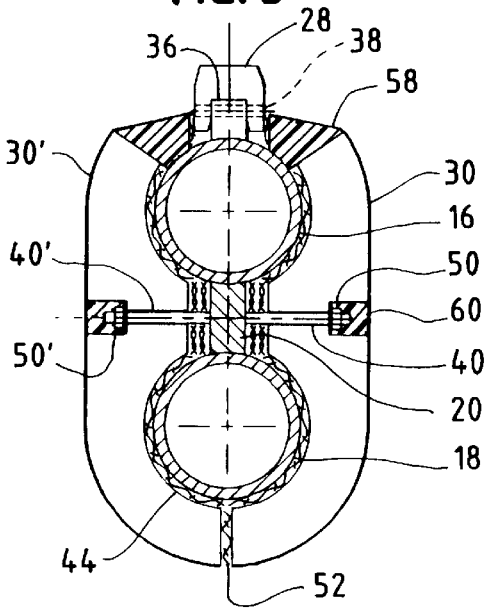
FIG. 3 is a sectional view of the skid pipe of FIG. 1 taken along line 3—3.

A number of wear castings 28, also known as "riders", are attached in a spaced relationship to the top of the top pipe 16 of the skid pipe. As a result, a steel slab workpiece, indicated in phantom at 29, is supported by the wear castings as it travels through the furnace. Typically, the wear castings are solid blocks of temperature resistant metal such as chrome alloys, nickel alloys and the like. The wear castings may be welded directly to the pipe or, as shown in FIGS. 1 and 2, welded to a bracket 36 which is welded to the top of the pipe. Alternatively, as shown in FIG. 3, the wear casting 28 may be bolted to the bracket 36 via bolt 38. Heat from the wear casting is withdrawn through the pipe 16, and into the water flowing therethrough, so that the wear casting does not lose its supportive strength.

To reduce the loss of heat from the furnace interior into pipes 16 and 18. and the water flowing therein, the skid pipe 10 is fitted with a number of refractory members 30. Similarly, vertical supports 12 and 14 are covered by refractory members 32 and 34. In addition, the refractory members protect the pipes from damage due to the high temperature of the furnace. The refractory members are preferably constructed of a high alumina castable refractory.

The installation of the refractory members 30 upon skid pipe 10 will now be explained with reference to FIGS. 2 and 3. A number of threaded studs 40 are first welded to the web 20 of the skid pipe. The studs preferably are constructed of a heat-resistant metal such as stainless steel. A ceramic fiber blanket 44 is next placed over the studs 40 and 40' and wrapped about the pipes 16 and 18 and web 20. For reasons that will be explained, an excess portion of the blanket is left extending from bottom pipe 18 and top pipe 16. The blanket provides an additional layer of insulation for the pipes and also provides shock absorption for the refractory members 30.

Each refractory member features arcuate portions 41 and 43 as well as an aperture 46 that is sized to receive the threaded studs 40. Once the blanket 44 is wrapped about the web and pipes of the skid pipe, two refractory members are placed over opposing studs 40 and 40' and are secured in place via the engagement of nuts 50 and 50' with studs 40 and 40', respectively. While nuts 50 and 50' (and washer 51) are illustrated, it should be noted that alternative removable fasteners may be used. The excess bottom portion of the blanket fills the gap 52 between the bottom edges of the refractory members 30 and 30'. Gap 52 allows the refractory members to expand when heated without contacting one another so that cracking is avoided.

Heat-resistant plastic, such as is available from the Harbison-Walker company, in moldable (pliant or malleable) form is pounded into place so that it covers and fills the space between the wear castings 28 and the refractory members 30 and 30', as indicated at 58. The excess top portion of the blanket 44 is placed adjacent to the base of wear casting 28 to further insulate it. Insulating the top of the skid pipe in such a fashion provides a number of advantages. The refractory members 30 and 30' are protected from damage should a wear casting break. More specifically, should a wear casting such as 28 break, the slab 29 (FIG. 1) would come into contact with the plastic 58 before the refractory members 30 and 30'. In addition, by surrounding the wear castings with plastic, their replacement is greatly simplified in that the bolts or welds securing them to the pipe may be more easily accessed. Finally, the plastic-filled gap 58 allows for the thermal expansion of members 30 and 30'.

As indicated at 60, plastic is also used to fill in the remaining portion of aperture 46 so that nut 50 is protected from the heat of the furnace. The plastic 60 may also be easily removed so that nut 50 may be accessed.

Figure 4:
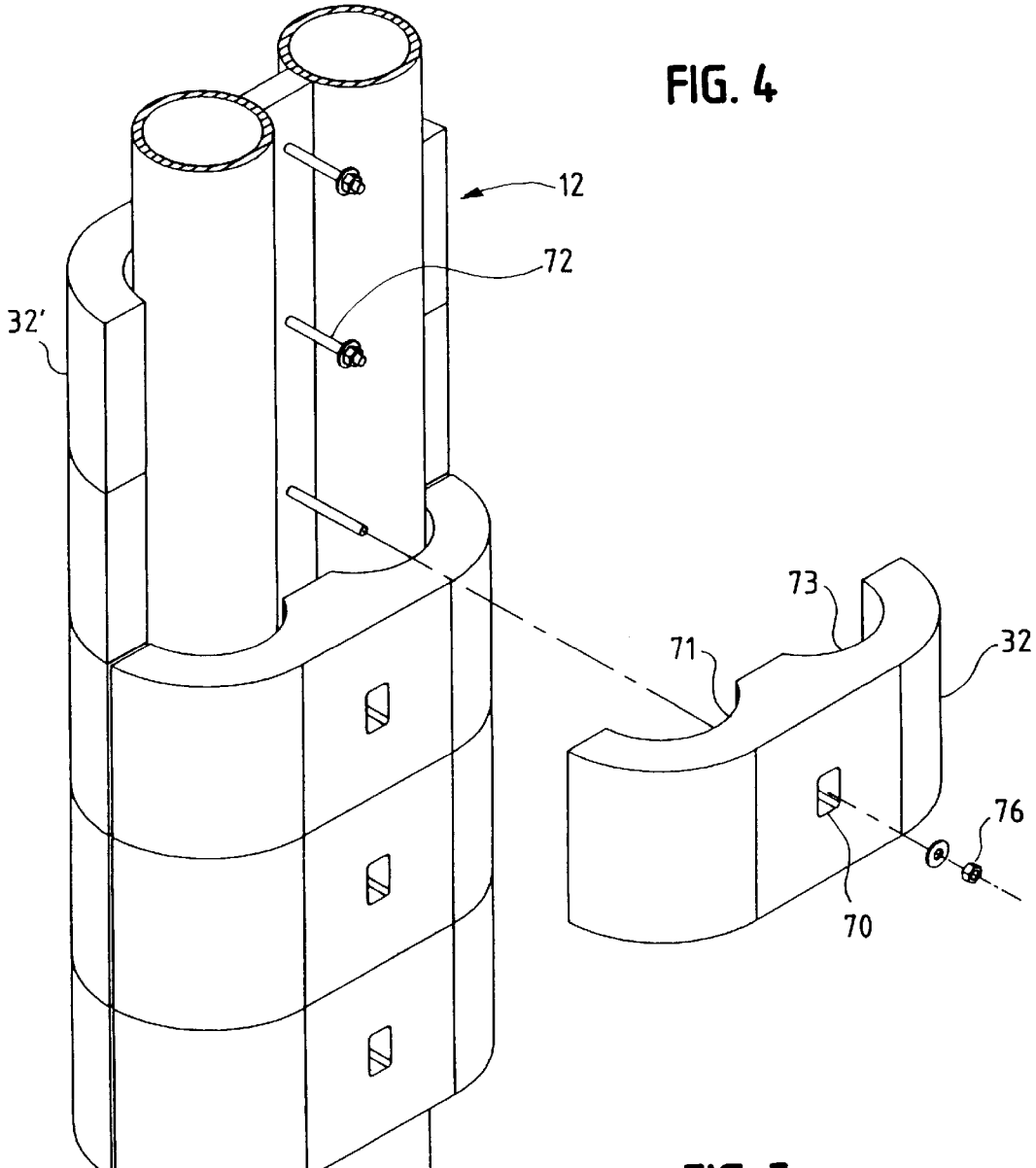
FIG. 4 is a perspective view of the left vertical support of FIG. 1 illustrating the installation of the pipe refractory insulation.
Figure 5:
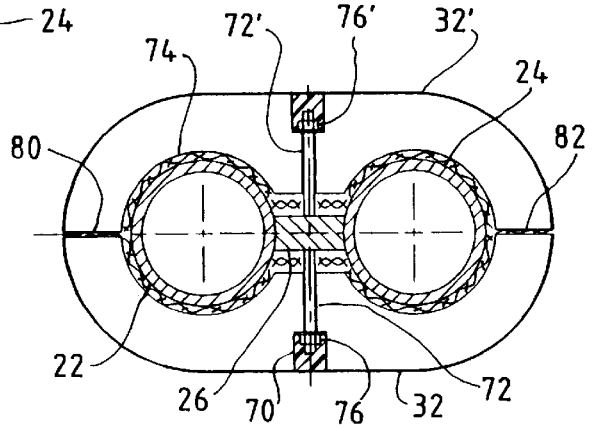
FIG. 5 is a sectional view of the vertical support of FIG. 4 taken along line 5—5 of FIG. 1.

The installation of refractory members 32 to dual-pipe support member 12 may be explained with reference to FIGS. 4 and 5. Each refractory member 32 features arcuate portions 71 and 73 and an aperture 70 that is sized to accommodate a threaded stud 72 that is welded to the web 26 of vertical support 12. A ceramic fiber blanket 74 is placed over the studs and around the pipes and web of the vertical support with excess portions extending from opposing surfaces of pipes 22 and 24. Refractory members 32 and 32' are then placed over the studs, and support member 12, and are secured with nuts 76 and 76'. Heat-resistant plastic is used to fill the remaining portion of aperture 70. The excess portions of the blanket 74 fill the gaps 80 and 82 between the refractory members 32 and 32'. Gaps 80 and 82 allow for the thermal expansion of the refractory members.

Figure 6:
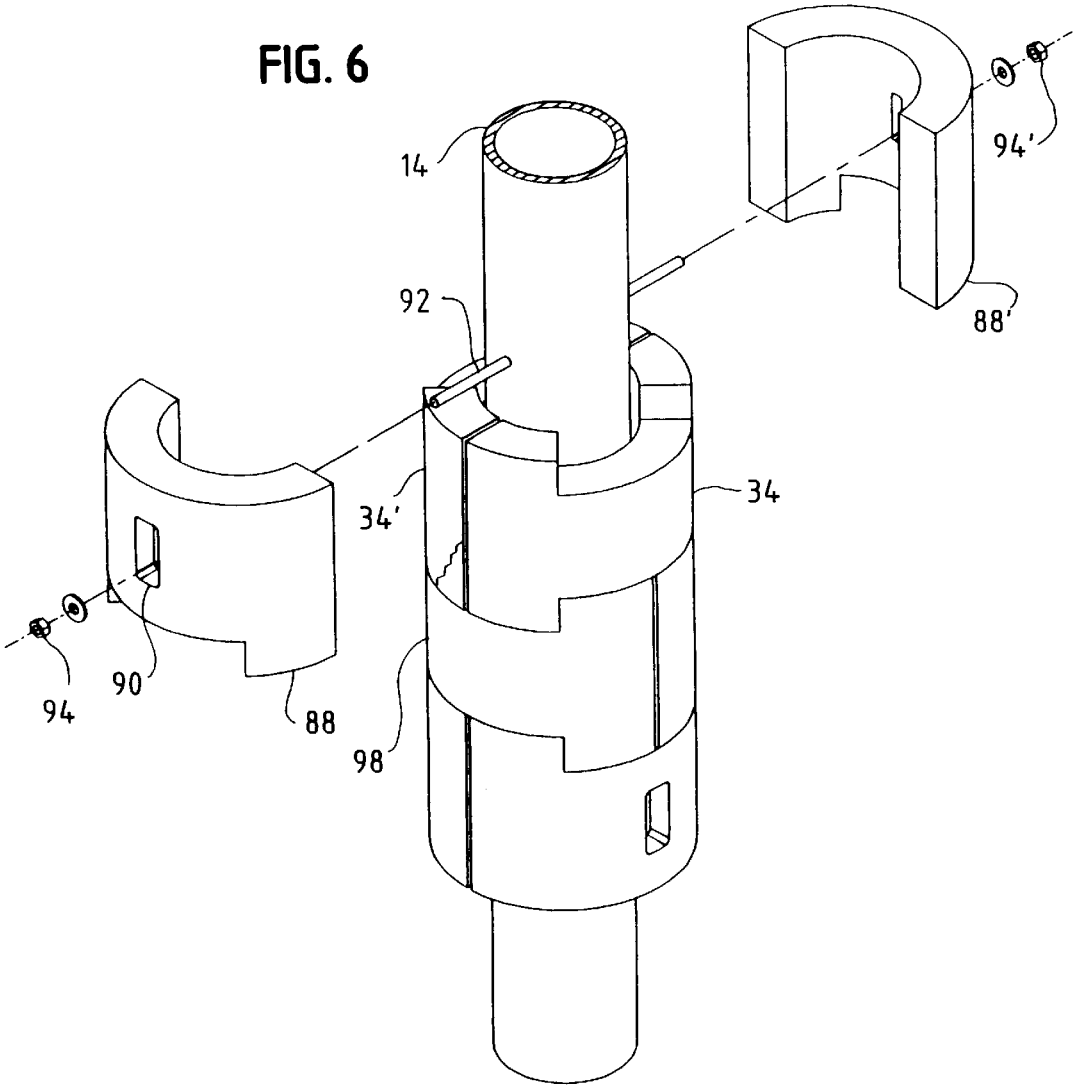
FIG. 6 is a perspective view of the right vertical support of FIG. 1 illustrating the installation of the pipe refractory insulation.
Figure 7:
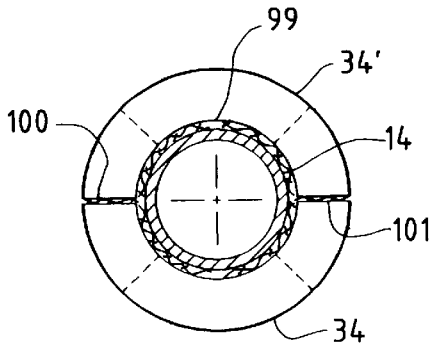
FIG. 7 is a sectional view of the vertical support of FIG. 6 taken along, line 7—7 of FIG. 1.
Figure 8:
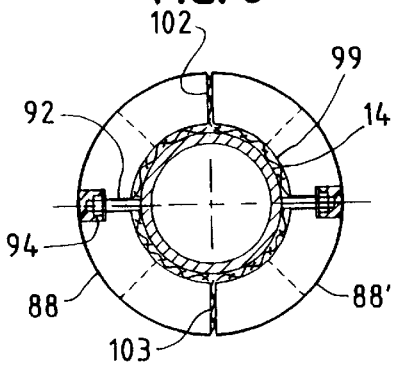
FIG. 8 is a sectional view of the vertical support of FIG. 6 taken along line 8—8 of FIG. 1.

FIGS. 6 through 8 illustrate the installation of refractory members 34 to single-pipe support 14. The refractory members feature an "H" shape so that they may interlock and support each others' weight upon placement about vertical support 14. As a result, the members 34 do not require studs or nuts to hold them in position.

Fastened refractory members such as 88 are positioned on the top and incrementally along vertical support 14. Each fastened refractory member features an elongated aperture 90 that receives a threaded stud such as 92. The elongated slot allows the end piece member 88 to be slid upwards, once nut 94 is loosened, so that a damaged member, such as 34', may be raised and disengaged from supporting members for replacement. A lower refractory member, such as the one indicated at 98, may be removed by loosening nuts 94 and 94' and then raising members 88, 88', 34 and 34'.

A ceramic fiber blanket 99 is loosely wrapped about pipe 14 prior to installation of the refractory members so that gaps such as 100, 101, 102 and 103 may be insulated. As in the previous installations, the gaps allow for thermal expansion of the refractory members.

Referring back to FIG. 1, once refractory members 30, 32, 34 and 88 are installed, castable refractory material 106 and 108 is used to cover the junction between the pipes of skid pipe 10 and vertical supports 12 and 14.

Figure 9:
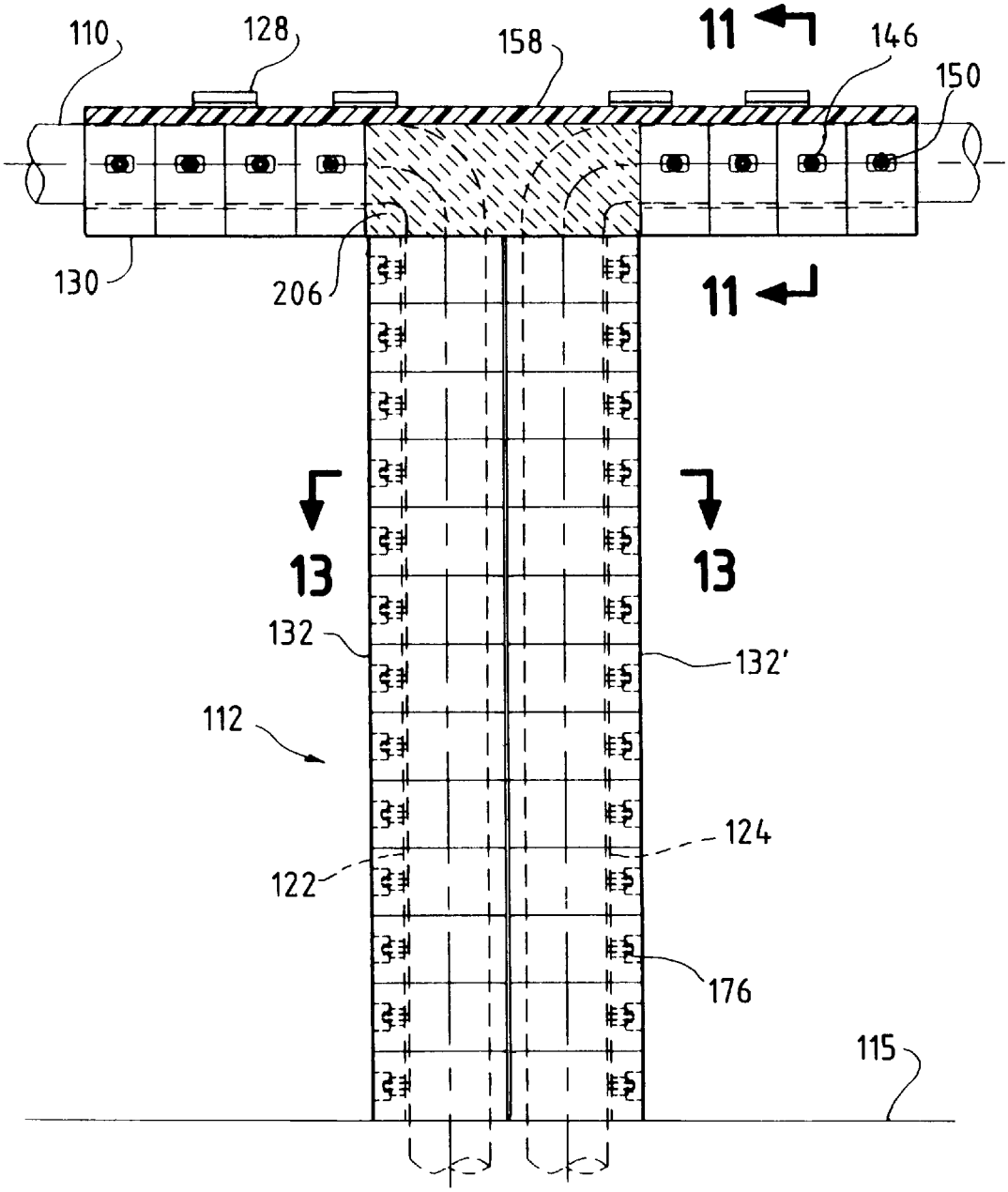
FIG. 9 is a side elevational view showing a portion of a skid pipe and a vertical support therefor in a reheat furnace upon which a second embodiment of the pipe refractory insulation of the invention has been installed.

FIG. 9 shows an embodiment of the pipe refractory insulation of the invention installed upon a structure that features a single pipe skid 110 supported by a dual-pipe vertical support 112 that does not possess a web. As with the embodiment of FIG. 1, the pipes 122 and 124 of the vertical support extend into the floor 115 of the furnace and receive water from a source (not shown). As a result, water flows through the pipes 122, 124 and 110 so that they are cooled and thereby retain their strength. Wear castings 128 for supporting steel slab workpieces are attached to the top of the skid pipe. The skid pipe is insulated by refractory members 130 while the vertical support is insulated by refractory members 132.

Figure 10:
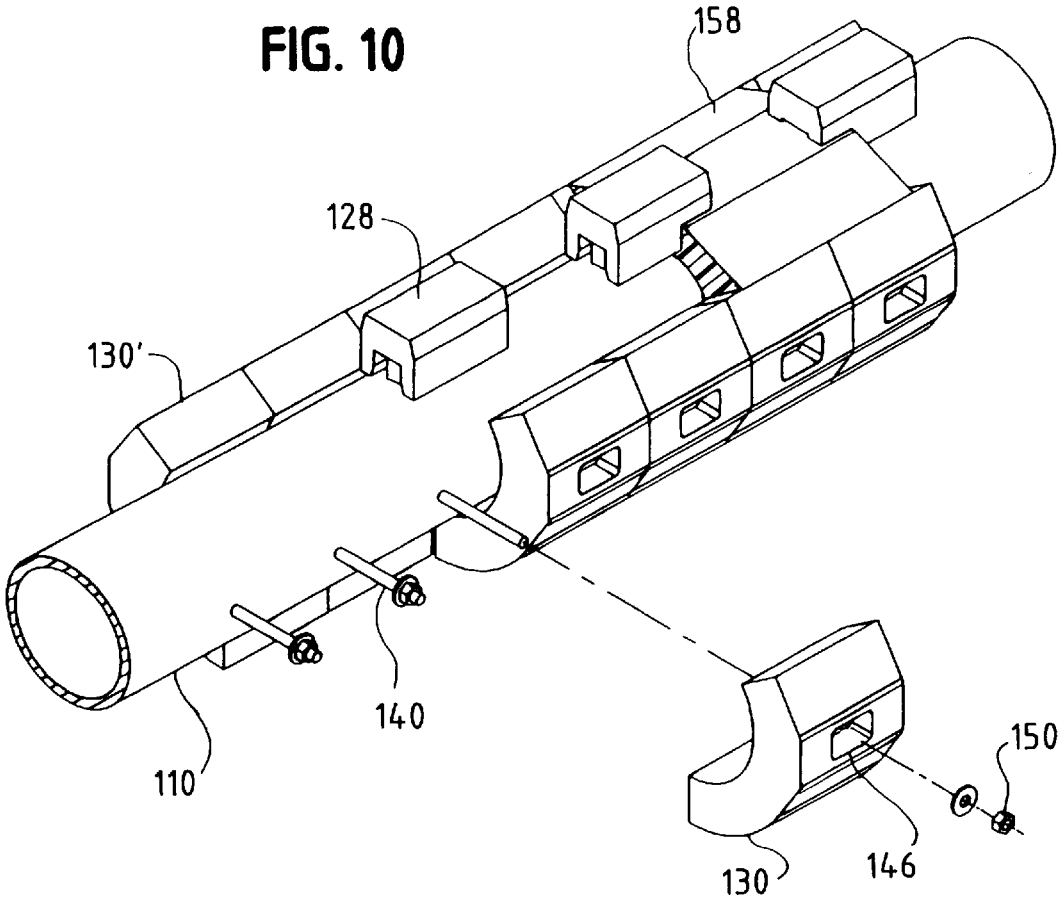
FIG. 10 is a perspective view of the skid pipe of FIG. 9 illustrating the installation of the pipe refractory insulation.
Figure 11:
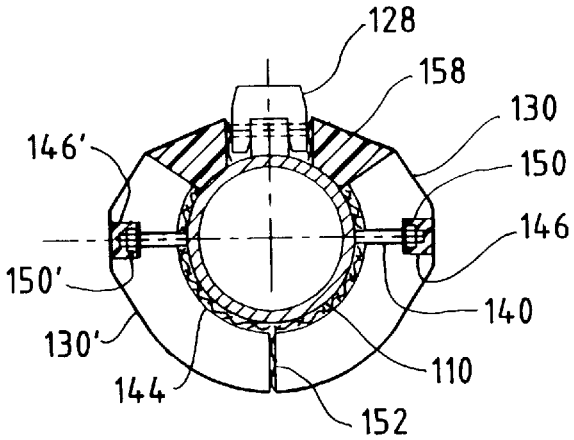
FIG. 11 is a sectional view of the skid pipe of FIG. 9 taken along line 11—11.

As illustrated in FIGS. 10 and 11, a number of spaced threaded studs 140 are welded to skid pipe 110. A ceramic fiber blanket 144 is placed over the studs and around the pipe with excess portions at the top and bottom. The refractory members 130 and 130', which feature apertures 146 and 146', are then placed over the studs and are secured in position with nuts 150 and 150'. The bottom excess portion of blanket may be used to fill gap 152, which allows for thermal expansion of the refractory members.

As illustrated at 158, heat-resistant plastic is used to till the space between the top edges of the refractory members and surrounding the base of the wear casting. The plastic is pounded into the space as a pliant (or malleable) solid and then hardens. Heat-resistant plastic is also used to fill the remaining portions of apertures 146 and 146'.

Figure 12:
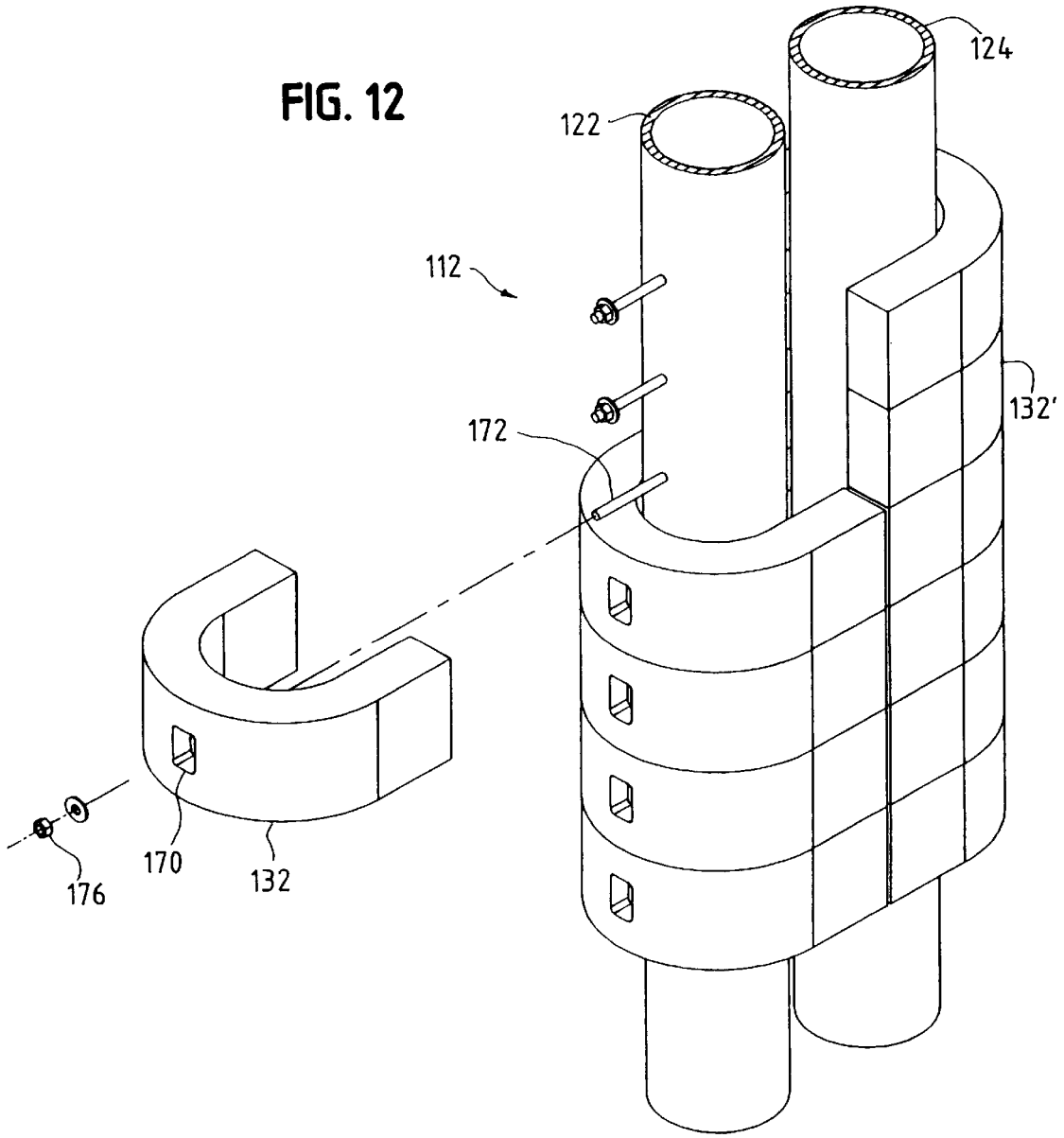
FIG. 12 is a perspective view of the vertical support of FIG. 9 illustrating the installation of the pipe refractory insulation.
Figure 13:
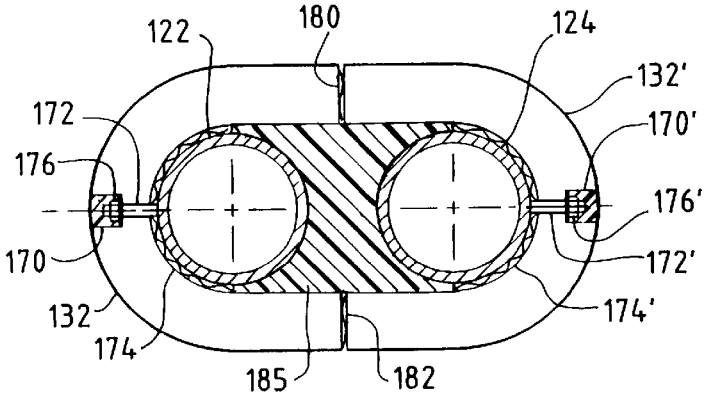
FIG. 13 is a sectional view of the vertical support of FIG. 9 taken along line 13—13.

As illustrated in FIGS. 12 and 13, refractory members 132 and 132', featuring apertures 170 and 170', are attached to vertical support 112 via threaded studs 172 and 172' welded to opposing surfaces of pipes 122 and 124. Nuts 176 and 176' secure the members in position. Prior to installation of the refractory members, ceramic fiber blanket sections 174 and 174' are placed over the studs and the opposing halves of pipes 122 and 124. Blanket sections are also used to fill the gaps between the refractory members as indicated at 180 and 182. The gaps allows for thermal expansion of the refractory members.

After all of the refractory members are attached to the vertical support (as illustrated in FIG. 9), heat-resistant plastic, in pliant or malleable form, is pounded into the top of the vertical support. As a result, the plastic hardens so as to fill the space between pipes 122 and 124, as illustrated at 185 in FIG. 13. The remaining portion of apertures 170 and 170' are also filled with plastic.

As a final step, castable refractory material 206 (FIG. 9) is used to cover the junction between skid pipe 110 and vertical support 112.

In addition to the advantages already described, the installation of FIGS. 1 and 9 allow a damaged refractory member to be removed by simply removing the plastic from its aperture and unfastening a nut. A replacement refractory member may then simply be secured in place by a nut and washer. Furthermore, because each pipe section is covered by two identical refractory member halves, only a few different types of refractory members need to be kept in stock at the operation for maintenance purposes.

While the preferred embodiments of the invention have been shown and described, it will be apparent to those skilled in the art that changes and modifications may be made therein without departing from the spirit of the invention, the scope of which is defined by the appended claims.

What is claimed is:

1. A thermal insulation system for cladding a fluid-cooled pipe comprising:

a. a plurality of studs welded directly to an exterior surface of a length of pipe to be insulated;

b. a plurality of preformed insulative refractory members adapted to cover a majority of a circumference of the pipe, each refractory member having an elongated aperture completely therethrough through which one of said studs may be received;

c. a plurality of removable fasteners engaging said studs so that said apertured refractory members are secured to said length of pipe and so that said apertured refractory members may slide parallel to a longitudinal axis of the pipe when said removable fasteners are loosened from said studs disposed through the apertures; and d. a plurality of refractory members which interlock with one another and which do not have apertures therethrough secured between the apertured refractory members thereby to cover a majority of the pipe surface, each of said interlocking refractory members without an aperture featuring an "H" shape so as to engage and disengage neighboring refractory members above and below by sliding parallel to the longitudinal axis of the pipe so that said refractory members without apertures may be removed without removing any fasteners from said studs.

2. The insulation system of claim 1 further comprising a blanket of insulation material disposed between said pipe surface and said refractory members.

3. The insulation system of claim 1 wherein said refractory members are positioned upon said pipe so that gaps exist between neighboring refractory members so that said neighboring refractory members may thermally expand without breakage.

4. The insulation system of claim 3 wherein the gaps are filled with blanket insulation.

5. The insulation system of claim 3 wherein the gaps are filled with heat-resistant plastic.

6. The insulation system of claim 3 wherein a wear casting is attached to said pipe surface within at least one of the gaps and the gap is filled with heat-resistant plastic.

7. The insulation system of claim 1 wherein the studs are threaded and the removable fasteners are nuts.

8. The insulation system of claim 1 wherein each of said refractory members has only a single aperture through which a single stud is received so that each of said refractory members is secured to the fluid-cooled pipe by a single stud and fastener.

* * * * *